United States Patent [19]

Hall et al.

[11] Patent Number: 5,007,404

[45] Date of Patent: Apr. 16, 1991

[54] WOODSTOVE FOR HEATED AIR FORCED INTO A SECONDARY COMBUSTION CHAMBER AND METHOD OF OPERATING SAME

[75] Inventors: Robert E. Hall, Cary, N.C.; Graig A. Spolek, Portland, Oreg.; John H. Wasser, Raleigh; Nelson L. Butts, Hillsborough, both of N.C.

[73] Assignee: The United States of America as represented by the Administrator of the U.S. Environmental Protection Agency, Washington, D.C.

[21] Appl. No.: 543,312

[22] Filed: Jun. 26, 1990

[51] Int. Cl.[5] ..... F24C 1/14

[52] U.S. Cl. ..... 126/77; 110/214; 422/173; 422/174

[58] Field of Search ..... 126/58, 77; 110/214, 110/211; 422/173, 174, 109

[56] References Cited

U.S. PATENT DOCUMENTS

| | | | |
|---|---|---|---|
| 3,146,072 | 8/1964 | Morgan | 422/174 |
| 3,248,178 | 4/1966 | Hoskinson | 422/174 |
| 4,515,089 | 5/1985 | Ehrlichmann | 110/214 |
| 4,870,910 | 10/1989 | Wright | 110/214 |

*Primary Examiner*—Carroll B. Dority

*Attorney, Agent, or Firm*—Lowe, Price, LeBlanc, Becker & Shur

[57] ABSTRACT

A resistance heater heats air forced by a fan into a woodstove secondary combustion chamber having an ignitor. The fan, heater and ignitor are controlled by a temperature sensor for gas flowing from a primary combustion chamber to a secondary combustion chamber. Two ignitors, extending through the stove back wall into the secondary combustion chamber, are controlled by the temperature sensor.

43 Claims, 2 Drawing Sheets

WOODSTOVE FOR HEATED AIR FORCED INTO A SECONDARY COMBUSTION CHAMBER AND METHOD OF OPERATING SAME

FIELD OF THE INVENTION

The present invention relates generally to woodstoves having secondary combustion chambers and more particularly to a woodstove having preheated secondary combustion air forced, by a fan means, into the secondary combustion chamber, and utilizing an ignition source controlled in response to the temperature of gases in the secondary chamber to sustain secondary combustion. In accordance with another object of the invention, air forced into the secondary chamber is heated by a heat source other than from the woodstove.

BACKGROUND ART

Use of wood as a fuel for residential heating has increased dramatically, resulting in a concomitant increase in air pollution. Airtight wood stoves, the type generally employed for residential heating, regulate heat output by throttling air supplied to a primary combustion chamber, to produce fuel-rich conditions that commonly cause unburned combustibles to be exhausted from the stove when the stove is operated at low heat rates. Most woodstoves used in the United States are generally operated at low burn rates because the stoves are located in a room being heated. If the stoves were operated at high burn rates, persons located in the room would become excessively warm. Most United States residential users of woodstoves prefer large stoves, which they operate at low burn rates, because such stoves need not be constantly filled with wood fuel. Burning the fuel at low burn rates, however, has the disadvantage of relatively low efficiency and high pollution because significant unburnt combustibles are exhausted from the stove.

Many design alternatives have been evaluated to provide more complete woodstove combustion. One of the most promising woodstove designs involves two chambers in the stove. A primary combustion chamber contains burning wood and includes an inlet, i.e. damper, for limited air entry. Usually, the damper is not fully open to provide a medium or low burn rate to sustain a smoldering fire that volatizes wood fuel. The resulting combustion gases pass into a secondary chamber, where combustion is theoretically completed with the aid of additional air introduced into the secondary combustion chamber from outside the stove. Theoretically, the advantage of this arrangement is that the fuel volatilization rate is decoupled from the combustion process so that complete combustion is achieved in the secondary chamber when low burn rates occur in the primary chamber.

It has been found that sustaining combustion in the woodstove secondary combustion chamber is difficult, at best, for low or medium burn rates in the primary chamber. The combustibles from the primary chamber and the air introduced into the secondary chamber must be well mixed. The composition of the mixture must be within flammability limits and the temperature of the mixture in the secondary chamber must exceed ignition temperature of the mixture therein. In a woodstove, the volatilization rate and the chemical composition of the combustibles change throughout a burn cycle. The flow rate of air introduced into the secondary chamber, which is usually naturally aspirated, changes with the flow rate of gases from the primary chamber into the secondary chamber, as does turbulence which causes mixing. The secondary chamber temperature also changes during a burn cycle.

The recommended procedure for operating certain woodstoves having secondary combustion chambers is to establish, for about one-half hour, a high burn rate in the primary combustion chamber with a damper to the secondary chamber closed. The temperature on the stove exterior may reach 800°–900° F. under these conditions. This operation causes combustion to occur in the secondary chamber when the damper to the secondary chamber is opened, and helps to remove tar and creosote from the walls of the chimney. However, a great deal of fuel is required to achieve this high burn rate and the room where the stove is located usually attains an excessively high temperature. Hence, this high burn rate operation is inefficient, although it is conducive to combustion in the secondary chamber immediately after the interchamber damper is opened. However, because of the high room temperature attained during the high burn rate operation, air flowing into the primary chamber is often severely throttled by closing a damper into the primary chamber when the interchamber damper is opened. This leads to a low or, at most, medium burn rate in the primary chamber, frequently, causing combustion to be quenched in the secondary chamber, so that desiderata of the secondary chamber are not achieved for a prolonged period.

Prior art woodstove design modifications to control the widely varying conditions in the primary and secondary chambers have attempted to promote sustained secondary chamber combustion. In attempts to sustain high temperature and combustion in the secondary chamber, the prior art has suggested: (1) preheating the supply of air fed into the secondary chamber, (2) regulating the composition of gases supplied to the secondary chamber, and (3) an external ignitor in the secondary chamber; see Allen et al. "Control of Emissions from Residential Woodburning by Combustion Modification" U.S. Environmental Protection Agency Report EPA-600/7-81-091 (1981). The effectiveness in reducing emissions of the first of these three concepts has been tested in the laboratory; see the aforementioned Allen et al. article, as well as Allen et al. "Control of Woodstove Emissions Using Improved Secondary Combustion" U.S. Environmental Protection Agency Report EPA-600/7-84-061 (1984); and Knight et al. "Efficiency and Emission Performance of Residential Wood Heaters with Advanced Designs," Proceedings of the APCA 76th Annual Meeting Atlanta, Georgia, 1983. In general, with these prior art techniques, emissions were reduced when the stove was operated at high burn rates. However, little or no emission reduction was observed at the low burn rates commonly used during "steady state" operation in United States residences.

Other techniques for sustaining combustion in the secondary combustion chamber have involved the use of a natural gas powered flame and electrical ignitors; see Spolek et al., "Secondary Combustion in a Dual-Chamber Woodstove," ASHRAE Transactions Vol. 91, Part 1, pages 1138–1146, 1988. Laboratory measurements of woodstove emissions using natural gas powered flames have demonstrated a substantial decrease during limited testing. However, experimentation with natural gas powered flames was suspended because of practical problems associated with supplying an external natural gas source to a woodstove. In experiments we conducted with electrical ignitors, wherein the ignitors were located on the secondary combustion chamber outside wall, it was found that the electrical ignitor did not result in complete combustion of products in the secondary chamber.

An object of the invention is to provide a new and improved dual chamber woodstove having secondary chamber combustion control and method of operating same.

It is another object of the present invention to provide a new and improved dual chamber woodstove having a secondary combustion chamber wherein the stove is efficiently operated and emissions, including particulates, are substantially reduced, even though fuel is being burned in a primary combustion chamber of the stove at a medium or low burn rate.

An additional object of the invention is to provide a new and improved dual chamber woodstove having automatic control of combustion in a secondary combustion chamber of the stove.

DISCLOSURE OF THE INVENTION

In accordance with one aspect of the present invention, a woodstove includes a primary combustion chamber for receiving a load of wood fuel, a secondary combustion chamber in a downstream fluid flow relation with the primary chamber, and fan means for forcing heated air originating outside of the woodstove into the secondary chamber. The forced flow of air into the secondary combustion chamber is controlled as a function of the temperature of gases exhausted from the primary chamber to the secondary chamber. If the gases are at a temperature less than a first predetermined level, e.g., 650° F., combustion in the secondary chamber is not possible; for temperatures greater than the predetermined level, combustion can occur in the secondary chamber if the air flow rate into the secondary chamber is at a predetermined value. The temperature sensing means preferably includes a temperature sensor at an inlet of the secondary chamber for gases from the primary chamber.

A control means responsive to the temperature sensor selectively energizes the fan means. The fan means is energized in response to the sensed temperature being greater than a first predetermined value and is deactivated in response to the sensed temperature being a second predetermined value, less than the first predetermined value to provide hysteresis or a deadband for fan operation. Hysteresis is desirable to prevent frequent on and off cycling, i.e., flutter, of the fan when the sensed temperature is about at the first predetermined value. If the sensed temperature is considerably above the first predetermined value, e.g., at 1200° F., combustion in the secondary chamber is assumed and the heating element, glow plugs and fan could be deactivated.

In accordance with a further aspect of the invention, an ignition means is provided for gases in the secondary chamber. The ignition means is controlled by the temperature sensor in a manner similar to that described for the fan means and with a delay in initial activation. The delay can be provided by sensing temperature or with a timer. The ignition means preferably includes first and second electric ignitors in the center part of the flow path of gases flowing from the primary chamber into the secondary chamber. It has been found that effective ignition is provided by mounting the a pair of glow plugs on the secondary chamber back wall, in contrast to the secondary chamber side wall. If a first glow plug does not produce combustion in the secondary chamber within a predetermined time period, the second plug is activated. The ignition voltage for the two ignitors can be equal or the second ignitor to be activated can be supplied with a higher voltage than the initially activated plug.

In accordance with another aspect of the invention a woodstove includes a primary combustion chamber for receiving a load of wood fuel, a secondary combustion chamber in fluid flow relation with the primary chamber, and fan means for forcing air from outside the woodstove into the secondary chamber, in combination with heater means responsive to a source other than from heat produced by the woodstove for heating the air forced by the fan means into the secondary combustion chamber. The heater, preferably a resistance coil, is initially activated in response to the temperature sensor in a manner similar to that of the fan, but at a higher temperature; e.g., the heater is activated in response to the sensed temperature being 700° F. It is important to turn the fan on before the heater to prevent overheating and possible failure of the heater.

The above and still further objects, features and advantages of the present invention will become apparent upon consideration of the following detailed description of a specific embodiment thereof, especially when taken in conjunction with the accompanying drawings.

DESCRIPTION OF THE PREFERRED EMBODIMENT

Figure 1:
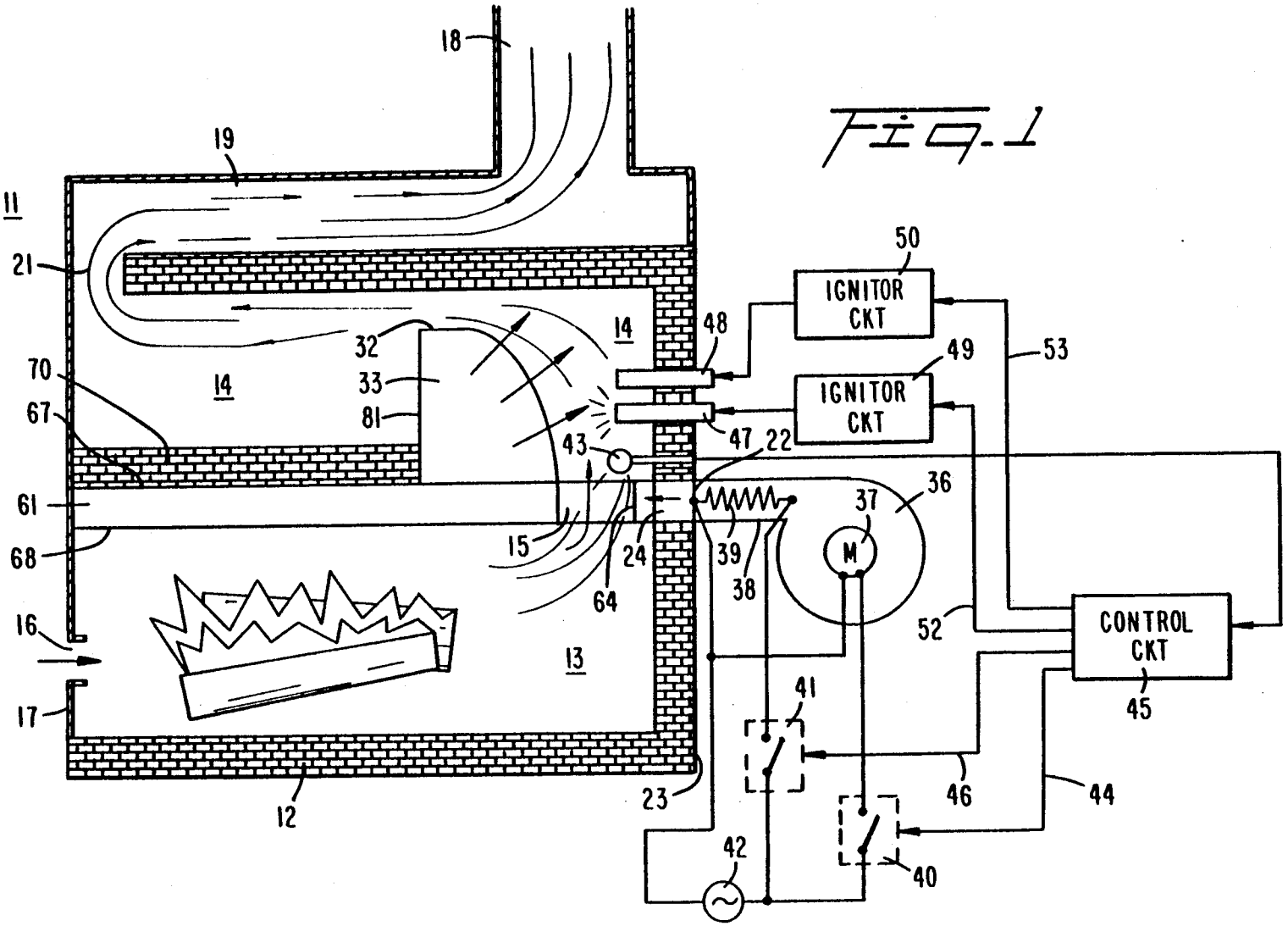
FIG. 1 is a side sectional view of a woodstove in combination with a schematic electric diagram of a controller for the woodstove in accordance with a preferred embodiment of the invention.

Reference is now made to the figures wherein woodstove 11, including fire brick wall 12, comprises primary combustion chamber 13 and secondary combustion chamber 14, mounted above the primary chamber and in fluid flow relation with it for combustion gases derived by the primary chamber. A Jotul commercially available woodstove, actually used to test the principles of the invention, has a so-called S-flow configuration to promote secondary combustion. Gaseous combustion products from primary chamber 13 continuously flow via opening, i.e., throat, 15 into chamber 14. Primary combustion chamber 13 is provided with an inlet, i.e. damper, 16 on front wall 17 of stove 11. Gases flow from secondary combustion chamber 14 to chimney 18 by way of flue 19 and passage 21, located between chamber 14 and flue 19, in proximity to front wall 17. Air from outside woodstove 11 flows into secondary combustion chamber 14 via port 22 in the stove back wall 23. All of the previously described structure is conventional, being incorporated in the Jotul stove, as well as other stoves.

Figure 2:
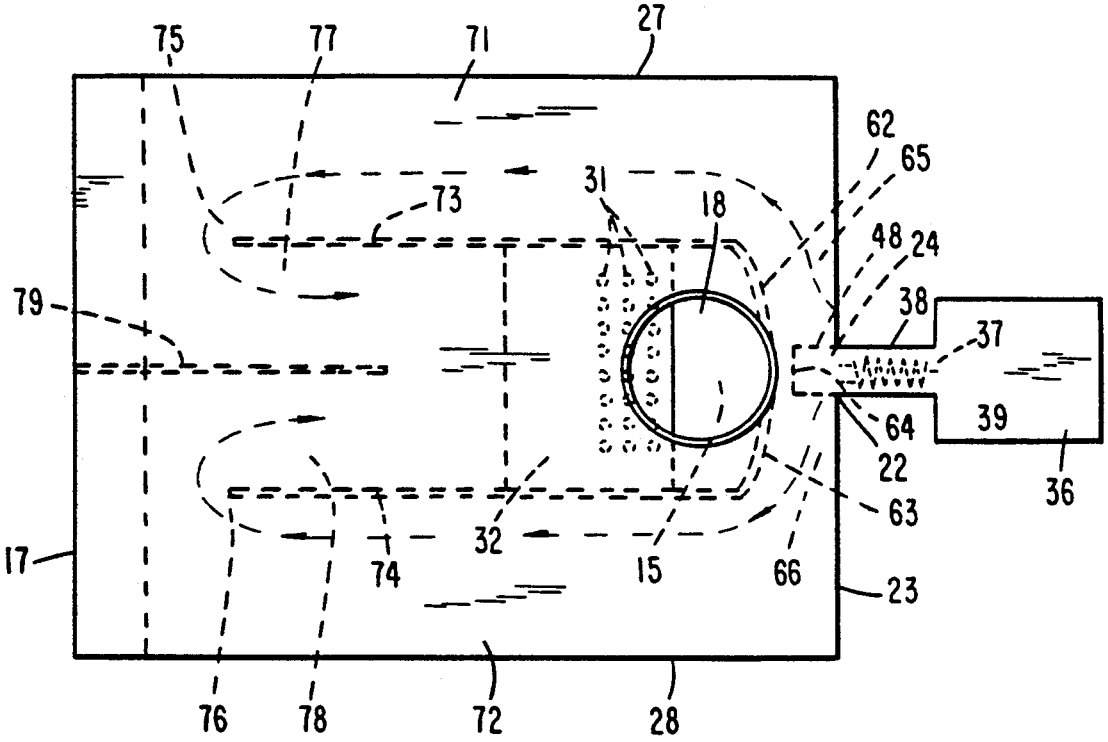
FIG. 2 is a top view of the woodstove illustrated in FIG. 1.

The Jotul stove is preferably modified, as illustrated in FIGS. 1 and 2, to provide a more circuitous path for air flowing from port 22 to plenum 33 and thereby provide greater heat transfer from primary chamber 13 to the air entering chamber 14 via holes 31 in arcuate wall 32 of plenum 33. The circuitous path is provided by subchamber 61 between chambers 13 and 14.

Air from blower 36 entering port 22 is divided into two identical flow paths by arcuate interior walls 62 and 63 that form septum 64 at the port. Entry chambers 65 and 66 are thereby formed by exterior wall 23 and interior walls 62 and 63 between plates 67 and 68 that define the top and bottom of subchamber 61. Air flows out of entry chambers 65 and 66 into longitudinally extending side chambers 71 and 72 respectively. Chambers 71 and 72 are respectively bounded by interior longitudinally extending walls 73 and 74 and exterior side walls 27 and 28, as well as plates 67 and 68. Walls 73 and 74 extend longitudinally from walls 62 and 63 and end short of exterior front wall 17 to provide openings 75 and 76. Air flowing from side chambers 71 and 72 flows transversely through openings 75 and 76 into chambers 77 and 78, separated by septum 79 that extends longitudinally from front wall 17 to a region slightly short of vertical wall 81 of plenum 33. Chambers 77 and 78 are thereby bounded by walls 73, 74, septum 79, and plates 67, 68. Air flowing out of chambers 77 and 78 flows into plenum 33 through a volume defined by plates 67, 68, walls 73, 74, the protruding end of septum 79, and a vertical projection of wall 32 between the plates. The resulting flow path from port 22 into plenum 33 is thereby relatively long to provide substantial heat transfer to the air from heat rising between chamber 13 and conducted through plate 68. To prevent substantial transfer of heat between the air in subchamber 61 and secondary 14, fire brick 70 is laid on the top of plate 67.

Outside air supplied to secondary combustion chamber 14 is heated as it is forced at constant flow rate by a fan means into port 22 in back wall 23 of stove 11. To these ends, blower 36, mounted on back wall 23, has an outlet connected via pipe 38 to port 22. Blower, i.e. fan, 36 includes constant speed drive motor 37, selectively connected by switch 40 to electric power source 42. In pipe 38 is positioned resistance heating coil 39, selectively connected by switch 41 to power source 42. Air outside of stove 11 is sucked through a cowling (not shown) on blower 36. The air sucked into blower 36 by blades on the shaft of motor 37 is forced through conduit 38, thence through port 22 and into subchamber 61 where it is heated. From subchamber 61, the heated air flows to plenum 33 and thence into secondary combustion chamber 14. Motor 37 of blower 36 and heating coil 39 are controlled automatically as a function of the temperature of gases flowing from chamber 13 to chamber 14 via opening or throat 15.

Outside air is forced at constant flow rate by blower 36 into chamber 14 when the gas flowing from chamber 13 into chamber 14 via throat or conduit 15 is sufficiently hot to be combusted in chamber 14. Additional heat is added by heater 39 to the air supplied by blower 36 to subchamber 61 as the temperature of gas supplied by chamber 13 to secondary chamber 14 incrementally increases.

The temperature of the gas supplied by chamber 13 to chamber 14 is sensed by thermocouple 43, positioned in secondary combustion chamber 14 immediately downstream of passage, i.e. throat, 15 so the thermocouple is basically above throat 15. In response to the temperature detected by thermocouple 43 being greater than a predetermined value, e.g., 650° F., an indication is provided that the gas flowing into chamber 14 is hot enough to be combusted.

The voltage generated by thermocouple 43, directly related to the temperature detected thereby, is supplied to controller 45. Controller 45 responds to the signal from thermocouple 43 so that in response to the voltage generated by thermocouple 43 being greater than a predetermined value, associated with 650° F., controller 45 derives an output signal on lead 44, commanding switch 40 to close to activate motor 37 of fan 36 so outside air is forced at a constant rate into chamber 14 via conduit 24, subchamber 61 and plenum 33. As the temperature sensed by thermocouple 43 increases to 700° F., circuit 45 derives a control signal that is supplied by lead 46 to close switch 41. While switch 41 is closed, current is supplied by source 42 to resistance heating coil 39, so that additional heat is supplied by the heating coil to the air flowing into secondary combustion chamber 14. For a tested Jotul stove, it has been experimentally found that the air entering conduit 24 should be preheated to about 700° F. and should flow at about 70 standard cubic feet per hour. While the preheating is provided by coil 39 and the heat transferred from chamber 13, it may also be supplied exclusively by heat from chamber 13 is the path from port 22 to plenum 33 is sufficiently long and the fuel burn rate is sufficiently high.

In certain instances, however, it has been found that combustion in chamber 14 is not achieved even though the air forced by blower 36 into chamber 14 is heated by coil 39, as well as by heat transferred from primary combustion chamber 13. The air forced into secondary combustion chamber 14 may not be adequately heated by resistance heater 39 and heat exchanged between primary combustion chamber 13 and subchamber 61 during startup conditions, during steady state medium, low or very low fuel burn rates in chamber 13, or at the end of the heating cycle, i.e., when the fire in primary combustion chamber 13 is dying out.

To provide ignition in secondary chamber 14 when the gas flowing through throat 15 is hot enough to be combusted, glow plugs 47 and 48 are mounted in vertical alignment about one-half inch from each other, on back wall 23. Other positions of the glow plugs are possible, e.g., they may be side-by-side, as long as the glow plugs are positioned in the center flow region of hot gases flowing from primary combustion chamber 13 into secondary combustion chamber 14 just after the gases have passed through passage 15 connecting the two chambers in fluid flow relation. Glow plug 47, in a preferred embodiment, is mounted approximately three inches above the top of plate 67.

Flow plugs 47 and 48 are respectively energized by ignitor circuits 49 and 50. Ignitor circuits 49 and 50 supply equal or unequal voltages to glow plugs 47 and 48 to which they are connected, e.g., ignitor circuits 49 and 50 can both supply the same voltages to glow plugs 47 and 48 or ignitor circuit 50 can supply a larger voltage to glow plug 48 than ignitor circuit 49 supplies to glow plug 47. Ignitor circuits 49 and 50 are responsive to output signals respectively derived by control circuit 45 on leads 52 and 53.

Control circuit 45 responds to thermocouple 43 to control ignitor circuits 49 and 50. In response to the temperature in secondary chamber 14, as indicated by the voltage derived by thermocouple 43 being below a predetermined value, e.g., the voltage associated with 750° F., a predetermined time, (e.g., two minutes) after activation of heater 39, control circuit 45 supplies a signal to lead 52, commanding ignition circuit 49 to supply an ignitor voltage to glow plug 47. In response to the voltage sensed by thermocouple 43 not exceeding the predetermined value within a predetermined time, e.g., 30 seconds, after initial application of voltage by ignitor circuit 49 to glow plug 47, control circuit 45 supplies a signal to lead 53, to command ignitor circuit 50 to supply an ignitor voltage to glow plug 48. Alternatively, glow plugs 47 and 48 can be activated in parallel simultaneously with heater 39 in response to the voltage sensed by thermocouple 43.

To prevent flutter to the activation of fan 36, heater 39, as well as glow plugs 47 and 48, and thereby enhance stability, controller 45 includes a deadband, i.e., hysteresis, for the activation and deactivation of each of these elements. Typically the deadband is about 50° F. Hence, fan 36, after having been turned on in response to thermocouple 43 sensing a temperature of 650° F., remains on until the thermocouple senses a temperature of 600° F.; heater 39 is respectively turned on and off when the thermocouple senses temperatures of 700° F. and 650° F. Depending on circuit design, glow plugs 47 and 48 may or may not be turned on simultaneously with heater 39 or they may or may not be turned off simultaneously with the heater.

If the temperature detected by thermocouple 43 rises above a predetermined value considerably in excess of the 650° F. value to turn on fan 36 initially (e.g., 1200° F.) for in excess of a predetermined interval, e.g. one minute, combustion in chamber 14 is assumed. Under these circumstances, it is no longer necessary for coil 39 to heat the air forced by fan 36 into chamber 14 and glow plugs 47 and 48 may or may not be de-energized depending on circuit design. To these ends, in response to thermocouple 43 sensing a temperature of about 1200° F. for one minute, control circuit 45 supplies signals to leads 46, 52 and 53, to command (1) opening of switch 41 which de-energizes coil 39 and (2) deactivation of ignitor circuits 49 and 50. AFter control circuit 45 supplies signals to leads 46, 52 and 53 to command deactivation of heater coil 36, as well as ignitor circuits 49 and 50, the control circuit continues to supply a signal to switch 40 to maintain the switch closed so fan 36 remains energized for a predetermined time interval, e.g., five minutes. Thereby, the air flowing through pipe 38 cools resistance heating coil 39 to enhance the coil life. If the temperature sensed by thermocouple 43 thereafter drops below the high predetermined value (e.g., 1200° F.) associated with combustion in chamber 14, switch 41 is immediately closed and ignitor circuits 49 and 50 are activated to immediately energize plugs 47 and 48 and the same cycle is repeated.

In tests conducted with a conventional Jotul woodstove having a construction generally indicated in FIGS. 1 and 2, wherein air at different flow rates and temperatures passed through port 22, there was generally decreased emission of carbon monoxide and unburned hydrocarbons from chamber 14 to chimney 18. For the tested stove it was found that air flowing through port 24 at a rate of 70 standard cubic feet per hour and heated by heater 39 to 700° F. produced optimum results for low and medium burn rates in chamber 13; low and medium burn rates occur when damper 16 is open to one quarter and one half its maximum opening, respectively. There appears to be a point of diminishing return when the air flow rate through port 22 is increased above approximately 80 standard cubic feet per hour or if the temperature of the air flowing into port 22 is in excess of 700° F. An air flow rate in excess of about 80 standard cubic feet per hour does not lead to further substantial emission reduction, and heating the air flowing into port 22 considerably in excess of 700° F. does not appear to significantly lower undesirable hydrocarbon, carbon monoxide, and particulate emissions. Hence, the increased energy necessary to drive blower 36 and resistor 39 to higher speed and greater heat output does not pay dividends with regard to reduced emissions and is not cost effective.

There is a reduction in efficiency if blower 36 is operated at a speed to achieve a flow rate in excess of 70 to 80 standard cubic feet per hour. There is also an efficiency reduction if coil 39 heats the air flowing through inlet 24 to in excess of 700° F. For medium and low burn rates with flow rates of less than 70 standard cubic feet per hour and air temperatures less than 700° F. at port 22, there is decreased efficiency of woodstove 11, as well as increased undesirable emissions in chimney 18. It is postulated that increasing the flow rate of air flowing into port 24 above 80 standard cubic feet per hour causes reduced efficiency and an increase in combustibles because the combustibles move through secondary combustion chamber at an excessive speed, i.e., the residence time of the combustibles in chamber 14 is not sufficient to permit complete combustion of the combustible gases in chamber 14. It is to be understood that the 70 cubic feet per hour flow rate is applicable to the relatively small volume Jotul stove and that the flow rate would appear to vary approximately in a linear manner with volume changes of the stove primary combustion chamber.

In summary, as the flow rate and temperature of air flowing through port 24 respectively increase from zero and ambient, there is a reduction in carbon monoxide, hydrocarbon and particulate emissions in chimney 18. However, this trend exhibited inconsistency when the stove was burned at a very low burn rate, i.e., a burn rate wherein damper 16 is open to only 10 percent of its maximum opening. A flow rate of secondary air at 70 standard cubic feet per hour and preheating that air to 700° F. provides a reasonable compromise of conditions to reduce emissions and maximize efficiency over the widest range of conditions.

While there has been described and illustrated one specific embodiment of the invention, it will be clear that variations in the details of the embodiment specifically illustrated and described may be made without departing from the true spirit and scope of the invention as defined in the appended claims. For example, a secondary combustion chamber, as described, in combination with a subchamber including a tortuous path for outside air, can be retrofitted to a single chamber stove. In such an instance, a housing including the subchamber and secondary combustion chamber is attached to the single chamber stove in downstream flow relation with gases exiting the single chamber stove. The single chamber stove flue is connected via a passage bounded by a wall in the subchamber to an inlet of the secondary chamber.

We claim:

1. A woodstove comprising a primary combustion chamber for receiving a load of wood fuel, a secondary combustion chamber in fluid flow relation with the primary chamber, fan means for forcing air from outside the woodstove into the secondary chamber, the air from outside the woodstove forced into the secondary chamber being heated prior to entering the secondary chamber, and means for controlling the fan means in response to the temperature of gases in the secondary chamber.

2. The woodstove of claim 1 further including heating means for fluid in the secondary chamber, the control means controlling the heating means in response to the temperature of gases in the secondary chamber.

3. The woodstove of claim 2 wherein the heating means includes an ignitor in the secondary chamber, the ignitor being responsive to the control means so the ignitor is turned on and off in response to the temperature of gases in the secondary chamber.

4. The woodstove of claim 3 wherein the heating means includes a heat source for air forced by the fan means into the secondary chamber, the heat source being responsive to the control means so the heat source is turned on and off in response to the temperature of gases in the secondary chamber.

5. The woodstove of claim 4 wherein the control means activates the fan means in response to the temperature of gases in the secondary chamber reaching a first predetermined value.

6. The woodstove of claim 5 wherein the control means activates the heater means in response to the temperature of gases in the secondary chamber reaching a second predetermined value, said second value being in excess of said first predetermined value.

7. The woodstove of claim 6 wherein the control means deactivates the heater means in response to the temperature of gases in the secondary chamber reaching a third predetermined value, said third value being considerably in excess of said second value, said second value being somewhat in excess of said first value.

8. The woodstove of claim 7 wherein the control means deactivates the heater means in response to the temperature of gases in the secondary chamber reaching a fourth predetermined value after said second value has been reached, said fourth value being somewhat less than said second value to provide a deadband.

9. The woodstove of claim 8 wherein the control means deactivates the fan means in response to the temperature of gases in the secondary chamber reaching a fifth predetermined value after said first value has been reached, said fifth value being somewhat less than said first value to provide a deadband.

10. The woodstove of claim 2 wherein the heating means includes a heat source for air forced by the fan means into the secondary chamber, the heat source being responsive to the control means so the heat source is turned on and off in response to the temperature of gases in the secondary chamber.

11. The woodstove of claim 10 wherein the control means activates the fan means in response to the temperature of gases in the secondary chamber reaching a first predetermined value.

12. The woodstove of claim 11 wherein the control means deactivates the fan means in response to the temperature of gases in the secondary chamber reaching a second predetermined value after said first value has been reached, said second value being somewhat less than said first value to provide a deadband.

13. The woodstove of claim 1 wherein the control means includes a temperature sensor at an inlet of the secondary chamber for gases from the primary chamber.

14. The woodstove of claim 1 further including ignitor means at an inlet of the secondary chamber for gases exhausted from the primary chamber, the ignitor means being responsive to the control means and the temperature of gases in the secondary chamber.

15. The woodstove of claim 14 wherein the ignitor means includes first and second glow plugs.

16. A secondary combustion chamber for gases exhausted from a primary combustion chamber of a woodstove, comprising fan means for forcing air from outside the woodstove into the secondary combustion chamber, the air from outside the woodstove forced into the secondary chamber being heated prior to entering the secondary chamber, and means responsive to the temperature of gases flowing from the primary chamber to the secondary chamber for controlling the fan means.

17. The chamber of claim 16 further including heating means for fluid in the secondary chamber, the control means controlling the heating means in response to the temperature of gases in the secondary chamber.

18. The chamber of claim 17 wherein the heating means includes an ignitor in the secondary chamber, the ignitor being responsive to the control means so the ignitor is turned on and off in response to the temperature of gases in the secondary chamber.

19. The chamber of claim 18 wherein the heating means includes a heat source for air forced by the fan means into the secondary chamber, the heat source being responsive to the control means so the heat source is turned on and off in response to the temperature of gases in the secondary chamber.

20. The chamber of claim 19 wherein the control means activates the fan means in response to the temperature of gases in the secondary chamber reaching a first predetermined value.

21. The chamber of claim 20 wherein the control means activates the heater means in response to the temperature of gases in the secondary chamber reaching a second predetermined value, said second value being in excess of said first predetermined value.

22. The chamber of claim 21 wherein the control means deactivates the heater means in response to the temperature of gases in the secondary chamber reaching a third predetermined value, said third value being considerably in excess of said second value, said second value being somewhat in excess of said first value.

23. The chamber of claim 22 wherein the control means deactivates the heater means in response to the temperature of gases in the secondary chamber reaching a fourth predetermined value after said second value has been reached, said fourth value being somewhat less than said second value to provide a deadband.

24. The chamber of claim 23 wherein the control means deactivates the fan means in response to the temperature of gases in the secondary chamber reaching a fifth predetermined value after said first value has been reached, said fifth value being somewhat less than said first value to provide a deadband.

25. The chamber of claim 17 wherein the heating means includes a heat source for air forced by the fan means into the secondary chamber, the heat source being responsive to the control means so the heat source is turned on and off in response to the temperature of gases in the secondary chamber.

26. The chamber of claim 25 wherein the control means activates the fan means in response to the temperature of gases in the secondary chamber reaching a first predetermined value.

27. The chamber of claim 26 wherein the control means deactivates the fan means in response to the temperature of gases in the secondary chamber reaching a fifth predetermined value after said first value has been reached, said fifth value being somewhat less than said first value to provide a deadband.

28. The chamber of claim 16 further including ignitor means at an inlet of the secondary chamber for gases exhausted from the primary chamber, the ignitor means being responsive to the control means and the temperature of gases in the secondary chamber.

29. The chamber of claim 28 wherein the ignition means includes first and second glow plugs.

30. A woodstove comprising a primary combustion chamber for receiving a load of wood fuel, a secondary combustion chamber in fluid flow relation with the primary chamber, fan means for forcing air from outside the woodstove into the secondary chamber, and means responsive to a source other than from heat produced by the woodstove for heating the air forced by the fan means into the secondary chamber prior to the forced air entering the secondary chamber.

31. The woodstove of claim 30 further including means for sensing the temperature of gases in one of the chambers, and means responsive to the temperature sensing means for controlling the heater means.

32. The woodstove of claim 31 wherein the temperature sensing means includes a temperature sensor at an inlet of the secondary chamber for gases from the primary chamber, the control means being responsive to the temperature sensor for controlling the heater means so the heater means is energized by the source in response to the temperature sensed by the first sensor being greater than a predetermined value.

33. The woodstove of claim 32 wherein the control means is responsive to the temperature sensor for controlling the heater means so the heater means is deenergized in response to the temperature sensed by the sensor being considerably greater than the predetermined value.

34. The woodstove of claim 32 further including ignition means in the secondary chamber for gases in the secondary chamber, and means for controlling the ignition means so the ignition means is activated in response to the temperature sensed by the sensor being greater than a predetermined value.

35. The woodstove of claim 34 wherein the ignition means includes first and second ignitors at said inlet of the secondary chamber, the ignition control means activating: (a) only one of said ignitors in response to the temperature sensed by the sensor being less than a predetermined value, and (b) both of said ignitors in response to one of said ignitors being activated while the temperature sensed by the first sensor is greater than a predetermined value.

36. The woodstove of claim 30 further including ignition means in the secondary chamber for gases in the secondary chamber, and means for controlling the ignition means as a function of the temperature of gases in one of the chambers.

37. The woodstove of claim 36 wherein the controlling means includes means for sensing temperature of gases in the secondary chamber.

38. A method of operating a woodstove having a primary combustion chamber for receiving a load of wood fuel and a secondary combustion chamber in fluid flow relation with the primary chamber, the method comprising forcing air from outside the woodstove into the secondary chamber, and heating the forced air with a heat source other than heat produced by the woodstove prior to the forced air being supplied to the secondary chamber.

39. The method of claim 38 further including controlling the heat source as a function of the temperature of gases in the secondary chamber.

40. The method of claim 39 wherein the secondary chamber includes ignition means for gases in the secondary chamber, and controlling the ignition means as a function of the temperature of gases in the secondary chamber.

41. The method of claim 40 wherein the ignition means includes first and second ignitors at an inlet of the secondary chamber for gases exhausted from the primary chamber, the method further including activating: (a) only one of said ignitors in response to the sensed temperature being in a first temperature range and (b) both of said ignitors while one of said ignitors is activated for a predetermined time and while the sensed temperature is less than a predetermined value.

42. The method of claim 38 wherein air flow from outside of the stove into the primary chamber causes the primary chamber to have a low or medium burn rate, the air from outside of the secondary chamber flowing into the secondary chamber being preheated prior to flowing into the chamber by the heat source to about 700° F.

43. The method of claim 38 wherein the secondary chamber includes ignition means for gases in the secondary chamber, and controlling the ignition means as a function of the temperature of gases in the secondary chamber.

* * * * *